US008537054B2

(12) United States Patent
Yen et al.

(10) Patent No.: US 8,537,054 B2
(45) Date of Patent: Sep. 17, 2013

(54) ANTENNA WITH MULTIPLE RESONATING CONDITIONS

(75) Inventors: Li-Jean Yen, Hsinchu (TW); Chia-Tien Li, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 206 days.

(21) Appl. No.: 13/196,878

(22) Filed: Aug. 2, 2011

(65) Prior Publication Data

US 2012/0299779 A1 Nov. 29, 2012

(30) Foreign Application Priority Data

May 27, 2011 (TW) ..... 100118609 A

(51) Int. Cl.
*H01Q 1/36* (2006.01)

(52) U.S. Cl.
USPC ..... 343/700 MS; 343/846

(58) Field of Classification Search
USPC ..... 343/700 MS, 702, 829, 846
See application file for complete search history.

(56) References Cited

U.S. PATENT DOCUMENTS

| | | | | |
|---|---|---|---|---|
| 6,646,606 | B2 * | 11/2003 | Mikkola et al. | 343/700 MS |
| 6,876,329 | B2 * | 4/2005 | Milosavljevic | 343/700 MS |
| 7,256,743 | B2 * | 8/2007 | Korva | 343/702 |
| 7,501,983 | B2 * | 3/2009 | Mikkola | 343/700 MS |
| 2007/0132641 | A1 * | 6/2007 | Korva et al. | 343/700 MS |

* cited by examiner

*Primary Examiner* — Tho G Phan
(74) *Attorney, Agent, or Firm* — Winston Hsu; Scott Margo

(57) ABSTRACT

An antenna with multiple resonating conditions includes a grounding element electrically connected to a ground, a radiating element, a connection element electrically connected between the grounding element and the radiating element, a feed-in element electrically connected between the connection element and the grounding element for receiving feed-in signals, and a radiating-condition generating element electrically connected to the grounding element and extending from the grounding element to the radiating element.

12 Claims, 10 Drawing Sheets

| | X | Y |
|---|---|---|
| m1 | 0.9000 | -3.7457 |
| m2 | 1.0500 | -3.5255 |
| m3 | 1.7000 | -5.0278 |
| m4 | 2.1500 | -2.3993 |
| m5 | 2.8500 | -29.2327 |

ANTENNA WITH MULTIPLE RESONATING CONDITIONS

BACKGROUND OF THE INVENTION

1. Field of the Invention

The present invention relates to an antenna with multiple resonating conditions, and more particularly, to an antenna generating multiple resonating conditions with one or more radiating-condition generating elements connected to ground, to achieve broadband operations.

2. Description of the Prior Art

An antenna is used for transmitting or receiving radio waves, to communicate or exchange wireless signals. An electronic product with a wireless communication function, such as a laptop, a personal digital assistant (PDA), usually accesses a wireless network through a built-in antenna. Therefore, for facilitating the user to access the wireless communication network more easily, an ideal antenna should have a wide bandwidth and a small size to meet the trends of compact electronic products within a permitting range, so as to integrate the antenna into a portable wireless communication equipment.

In the prior art, one of the common antennas for wireless communication is a planar inverted F antenna (PIFA), as implied by the name, whose shape is similar to a rotated and inverted "F". Please refer to FIG. 1A and FIG. 1B, FIG. 1A is a schematic diagram of a conventional PIFA antenna 10, and FIG. 1B is a schematic diagram of voltage standing wave ratio (VSWR) of the PIFA antenna 10. As shown in FIG. 1A, the PIFA antenna 10 includes a grounding element 100, a radiating element 102, a connection element 104 and a feed-in element 106. The connection element 104 connects the grounding element 100 and the radiating element 102, such that a resonating path of a monopole antenna is reduced from a half wavelength to a quarter wavelength, and thus the size of the antenna can be reduced effectively.

Besides, as can be seen from FIG. 1B, the PIFA antenna 10 only has one resonating condition. However, as the wireless communication technology progresses, operating frequencies of different wireless communication systems may be different; therefore, an ideal antenna should cover bandwidths of different wireless communication networks within a single antenna. In such a situation, the prior art further derives a dual-band antenna with two resonating conditions from the PIFA antenna 10.

Please refer to FIG. 2A and FIG. 2B. FIG. 2A is a schematic diagram of a conventional dual-band antenna 20, and FIG. 2B is a schematic diagram of VSWR of the dual-band antenna 20. The dual-band antenna 20 includes a grounding element 200, a radiating element 202, a connection element 204 and a feed-in element 206. The radiating element 202 is composed of a first radiator 2020 and a second radiator 2022 corresponding to high frequency band and low frequency band, respectively. The connection element 204 is composed of branches 2040 and 2042 connected together. The branch 2040 is connected to the radiating element 202 and the feed-in element 206, and the branch 2042 is connected to the feed-in element 206 and the grounding element 202. As can be seen from FIG. 2A, the dual-band antenna 20 has advantages of low profile, i.e. a small height, small size and easy production. Meanwhile, as can be seen from FIG. 2B, the dual-band antenna 20 has dual resonating conditions suitable for dual-band application, and achieves the optimization of the antenna characteristic.

Although the dual-band antenna 20 can achieve dual resonating conditions, for a wireless communication system with broad bandwidth, such as long term evolution (LTE) system, the bandwidth of the dual-band antenna 20 is still not enough, resulting in limitations of its application range. Therefore, how to increase bandwidth of an antenna has become one of the goals in the wireless technology industry.

SUMMARY OF THE INVENTION

It is therefore an object to provide an antenna with multiple resonating conditions.

An antenna with multiple resonating conditions includes a grounding element electrically connected to a ground, a radiating element, a connection element electrically connected between the grounding element and the radiating element, a feed-in element electrically connected between the connection element and the grounding element for receiving feed-in signals, and a radiating-condition generating element electrically connected to the grounding element and extending from the grounding element to the radiating element.

An antenna with multiple resonating conditions includes a grounding element electrically connected a ground, a radiating element, a connection element electrically connected between the grounding element and the radiating element, a feed-in element electrically connected between the connection element and the grounding element for receiving feed-in signals, and a plurality of radiating-condition generating elements electrically connected to the grounding element respectively and extending from the grounding element to the radiating element.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
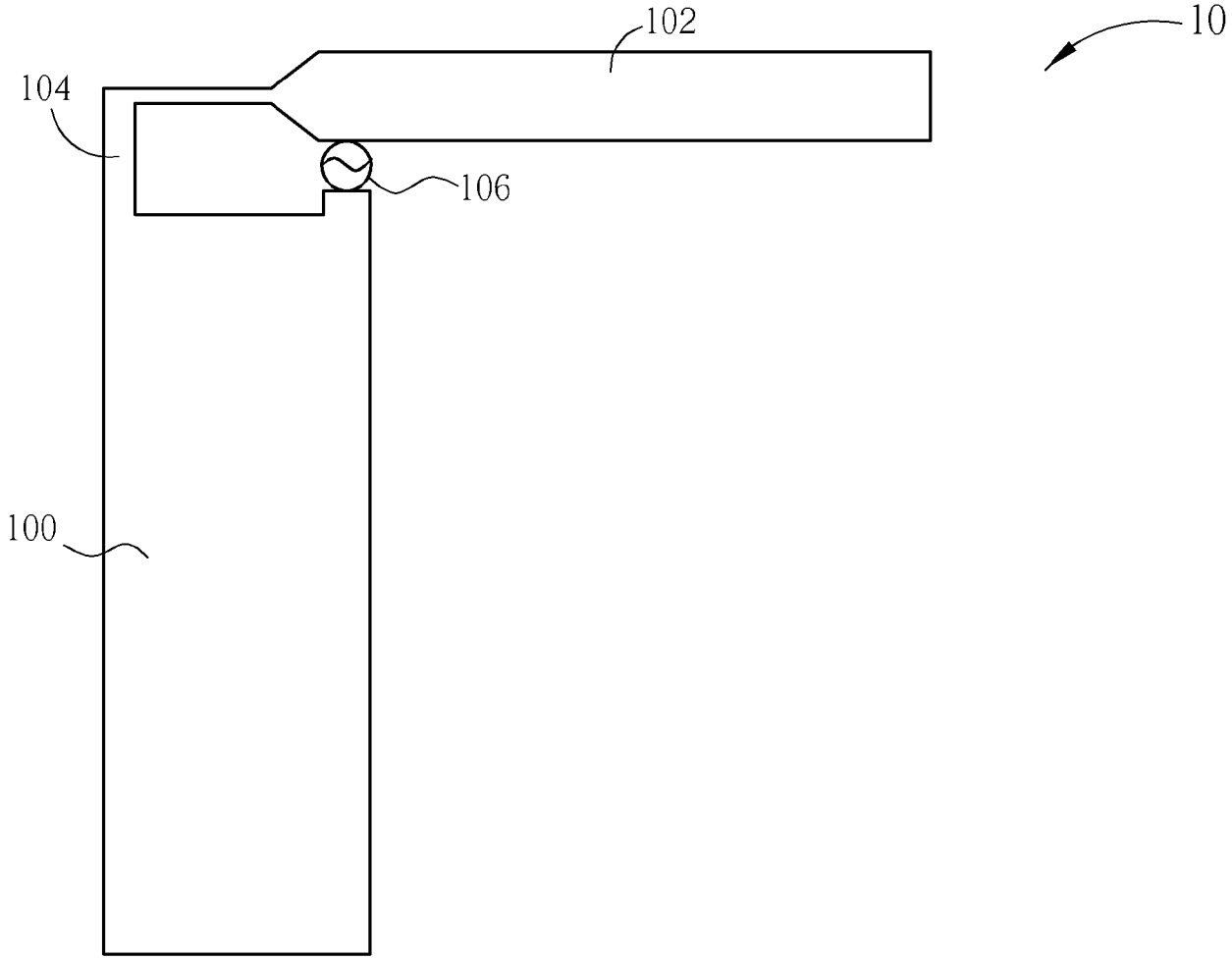
FIG. 1A PRIOR ART
FIG. 1A is a schematic diagram of a conventional PIFA antenna.
Figure 1B:
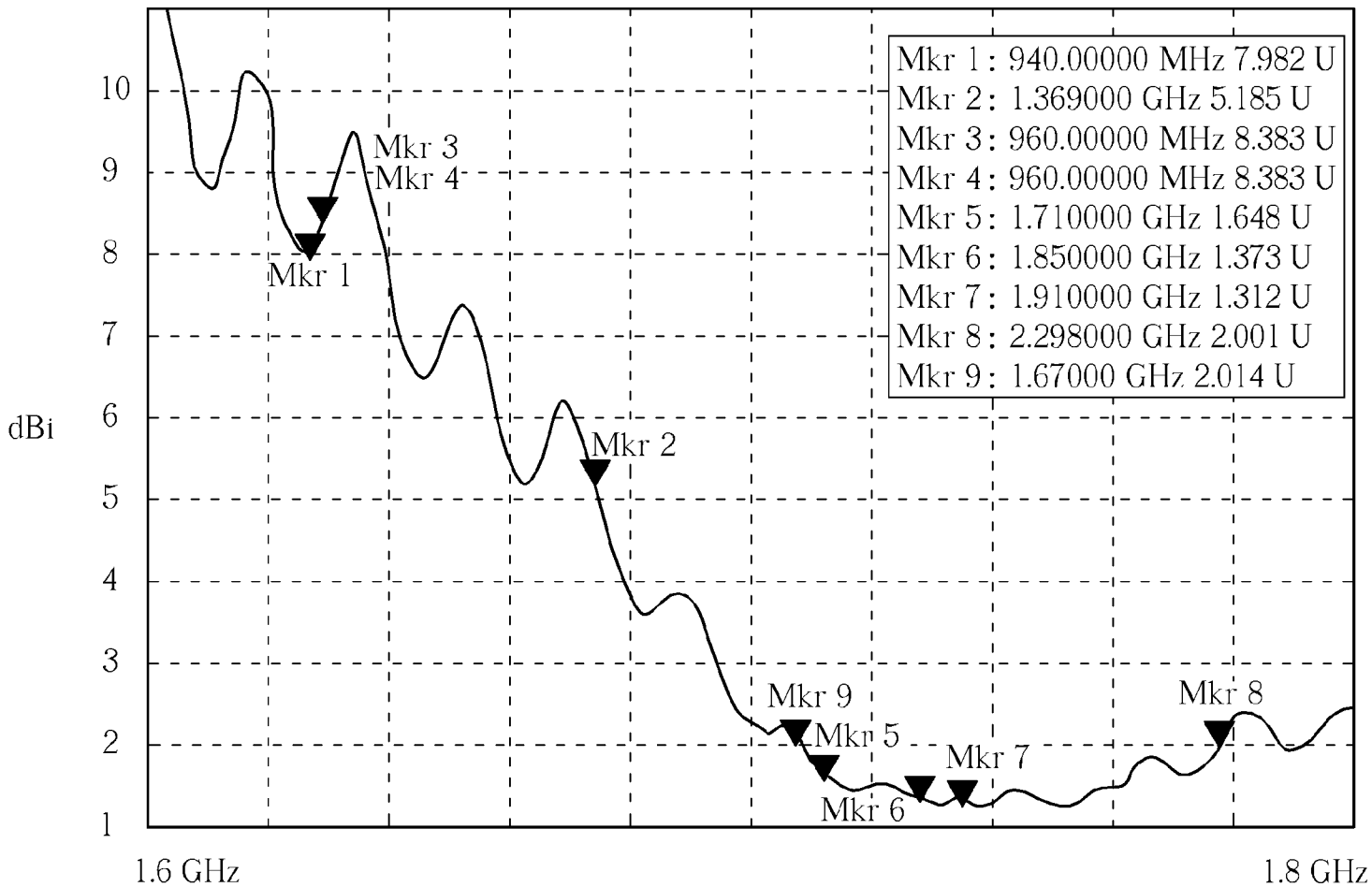
FIG. 1B PRIOR ART
FIG. 1B is a schematic diagram of VSWR of the PIFA antenna.
Figure 2A:
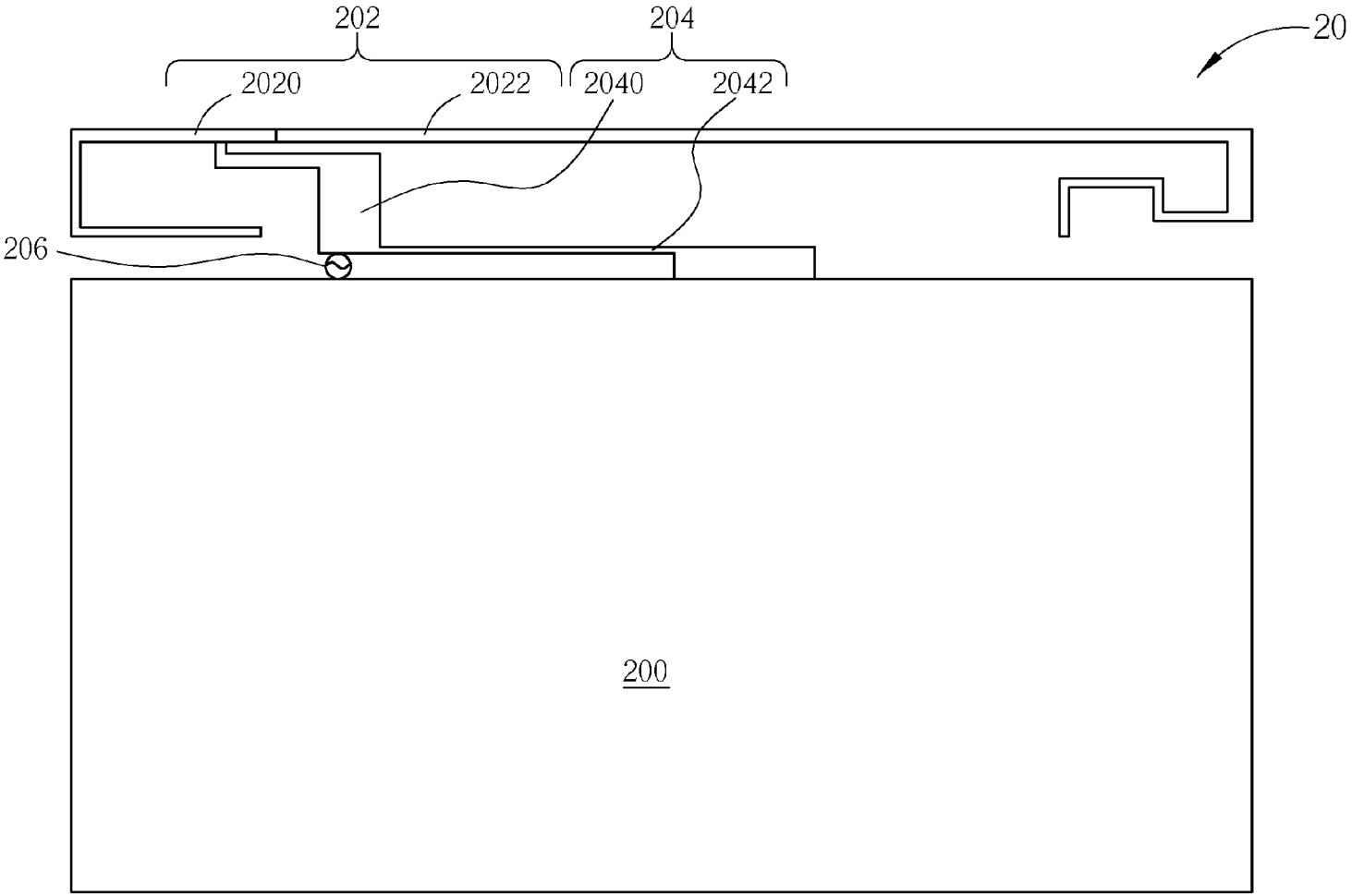
FIG. 2A PRIOR ART
FIG. 2A is a schematic diagram of a conventional dual-band antenna.
Figure 2B:
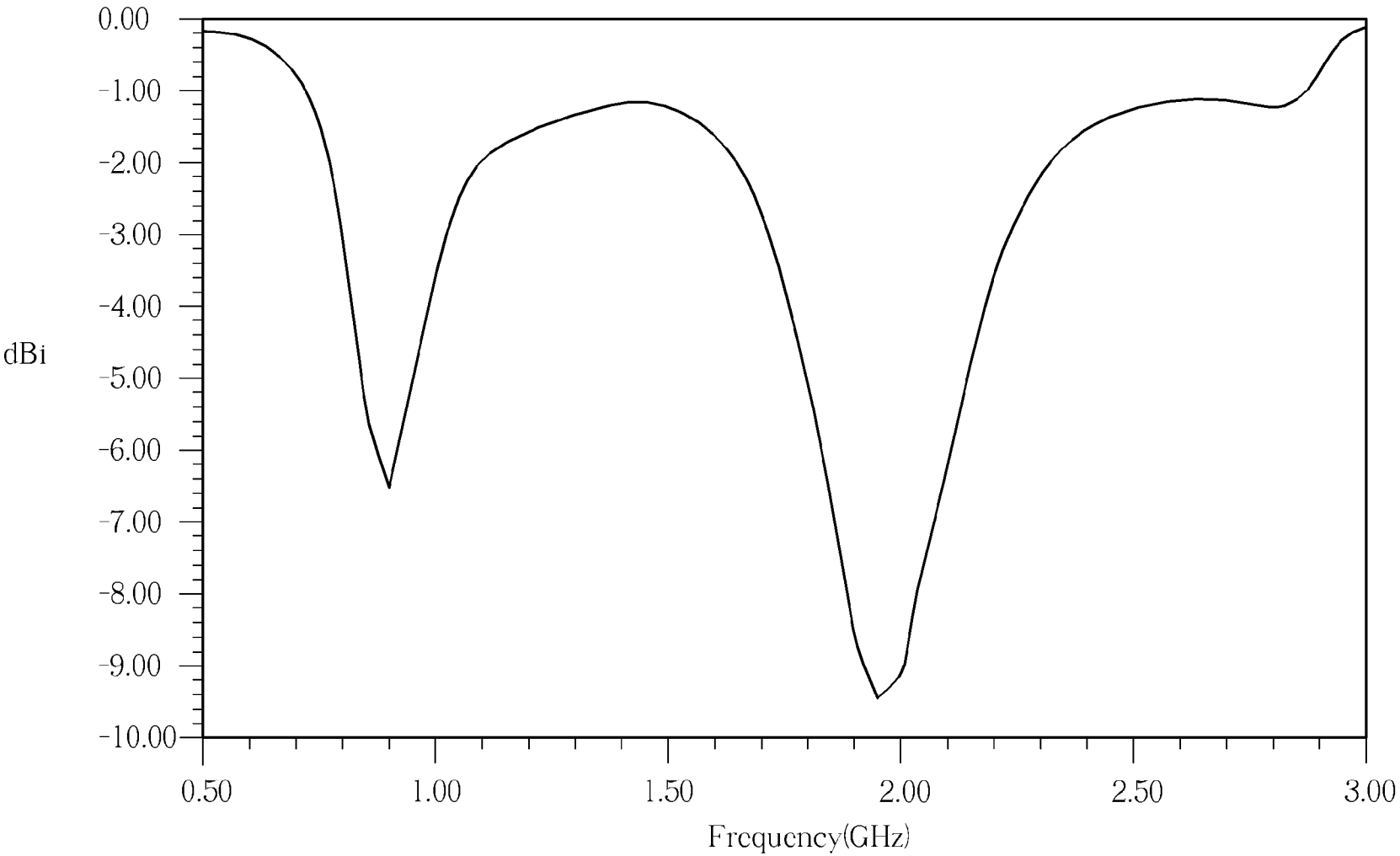
FIG. 2B PRIOR ART
FIG. 2B is a schematic diagram of VSWR diagram of the dual-band antenna.
Figure 3:
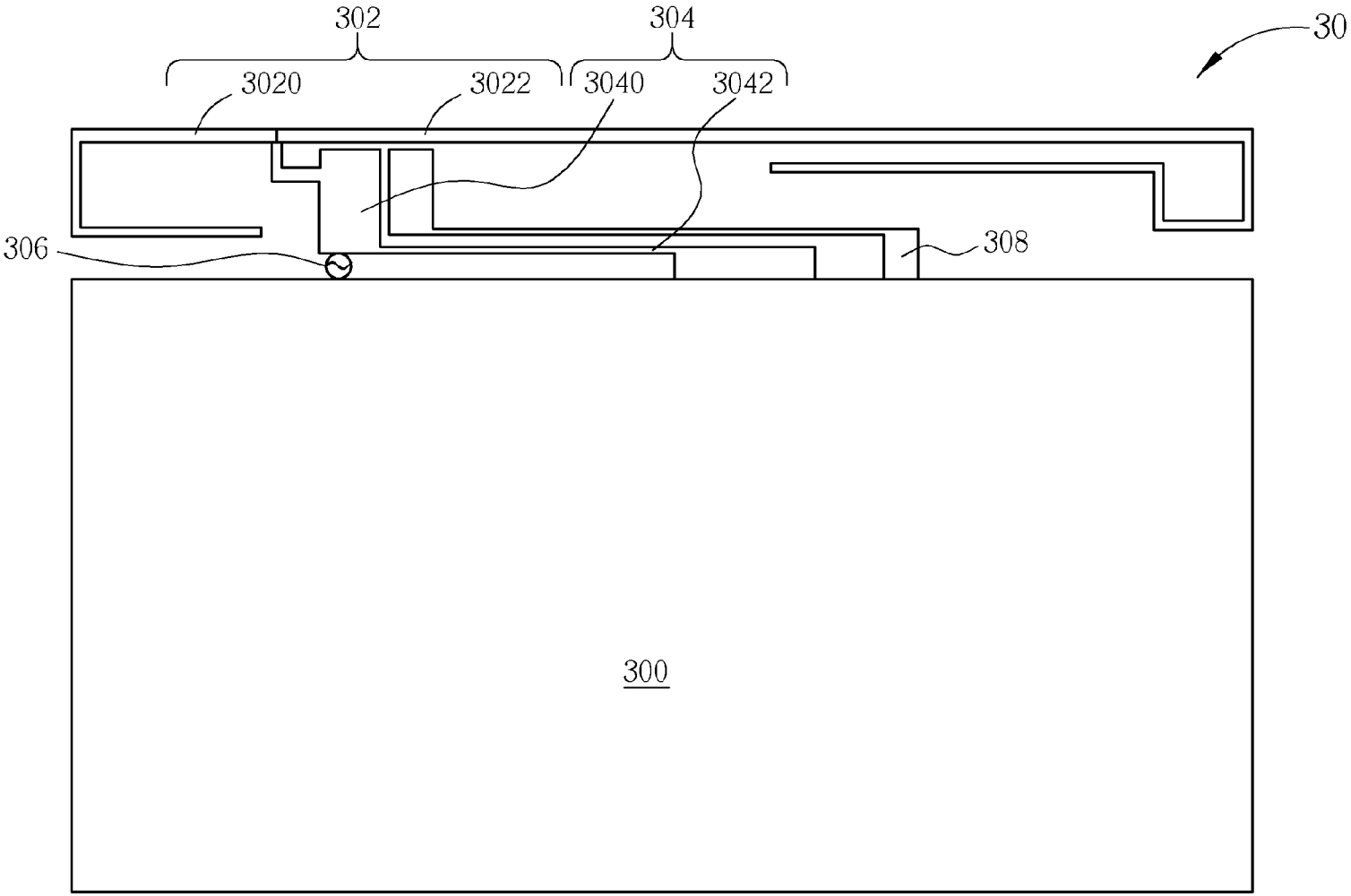
FIG. 3 is a schematic diagram of an antenna according to an embodiment of the present invention.

Please refer to FIG. 3, which is a schematic diagram of an antenna 30 according to an embodiment of the present invention. The antenna 30 has multiple resonating conditions, and includes a grounding element 300, a radiating element 302, a connection element 304, a feed-in element 306 and a radiating-condition generating element 308. The grounding element 300 is electrically connected to a ground for providing grounding. The radiating element 302 is composed of a first radiator 3020 and a second radiator 3022 extending along different directions and with different lengths to provide two different radiation frequency bands. The connection element 304 is composed of a first branch 3040 and a second branch 3042. The first branch 3040 is connected to the radiating element 302 and the feed-in element 306, and the second branch 3042 is connected to the feed-in element 306 and the grounding element 302. Therefore, comparing FIG. 3 with FIG. 2, structures of the antenna 30 and the dual-band antenna 20 are similar, while the difference is that the antenna 30 adds the radiating-condition generating element 308. As shown in FIG. 3, the radiating-condition generating element 308 is extended from the grounding element 300 to the radiating element 302, and has a shape substantially conforming to a shape of the connection element 304. Therefore, a coupling effect between the radiating-condition generating element 308 and the radiating element 302 or the connection element 304 generates an extra current path, so as to resonate another radiating condition.

In short, the antenna 30 resonates dual radiating conditions through the radiating element 302, and further resonate another radiating condition through the radiating-condition generating element 308 connected to the ground, so as to achieve effects of multiple radiating conditions or broadband. Noticeably, the present invention is to provide extra current path to the ground through the radiating-condition generating element 308, so as to increase radiating conditions, and those skilled in this art should make modifications or alterations accordingly. For example, in FIG. 3, the radiating-condition generating element 308 is only connected to the grounding element 300, and not connected to the radiating element 302. In practice, the radiating-condition generating element 308 can connect to the radiating element 302 as well. Please refer to FIG. 4, which is a schematic diagram of an antenna 40 according to an embodiment of the present invention. Structures of the antenna 40 and the antenna 30 shown in FIG. 3 are similar, and thus same elements are denoted by the same symbols. Difference between the antenna 40 and the antenna 30 is that a radiating-condition generating element 408 of the antenna 40 is connected between the grounding element 300 and the radiating element 302, which belongs to double grounding structure of the present invention, and thus effects of multiple radiating conditions or broad band can be achieved as well.

Figure 4:
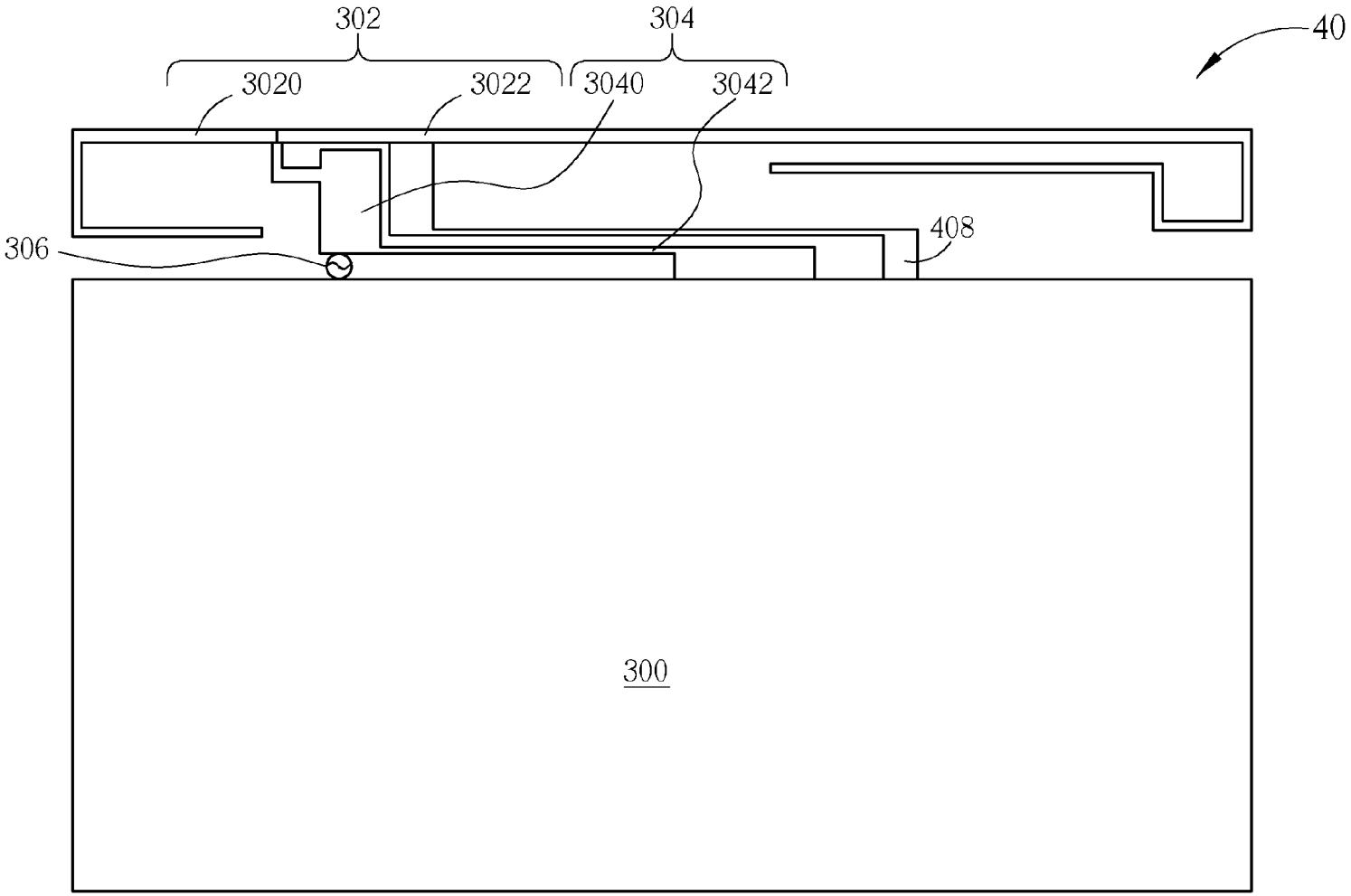
FIG. 4 is a schematic diagram of an antenna according to an embodiment of the present invention.
Figure 5A:
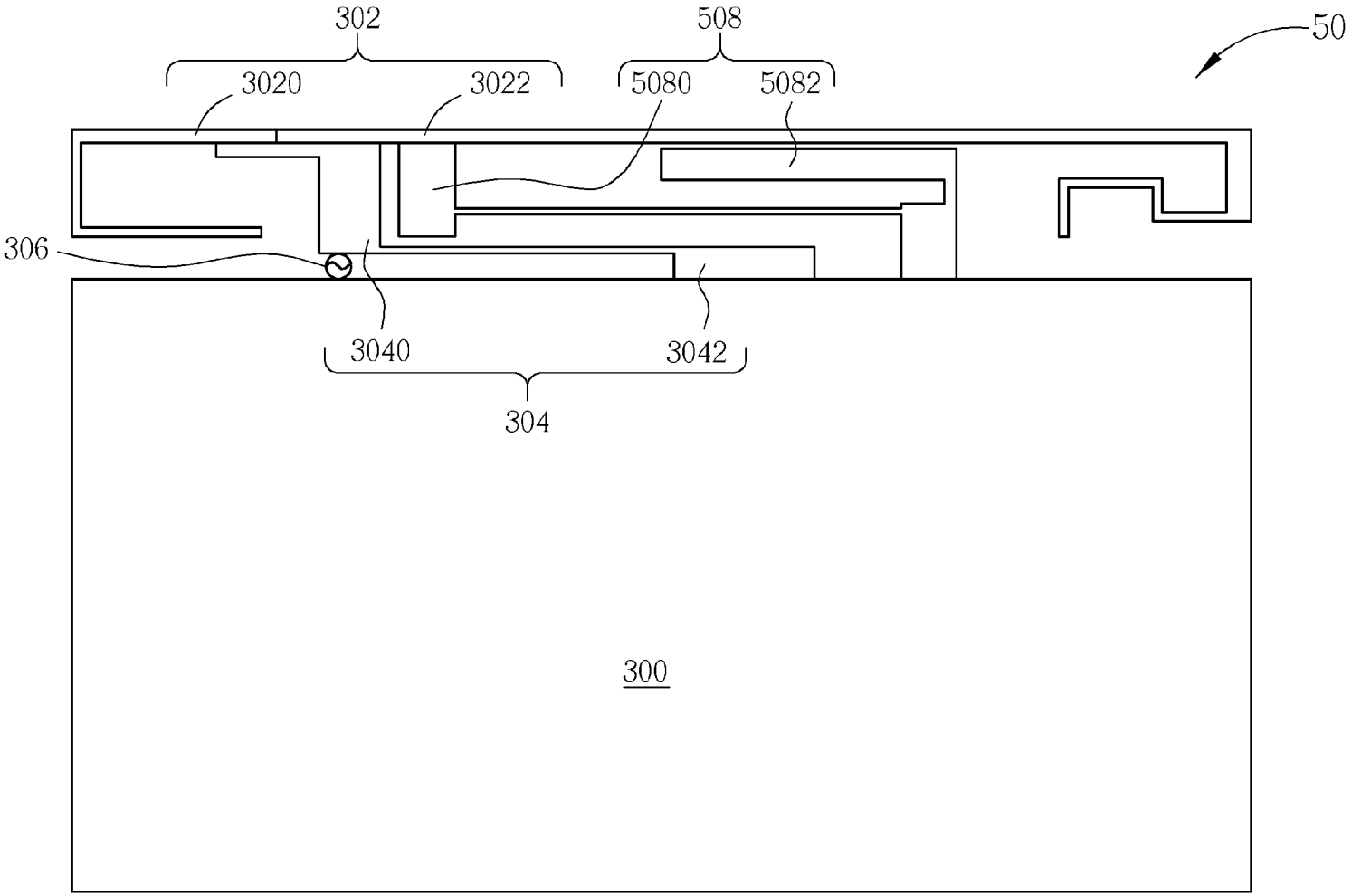
FIG. 5A is a schematic diagram of an antenna according to an embodiment of the present invention.

Besides, in the antennas 30 and 40, the shapes of the radiating-condition generating elements 308 and 408 both substantially conform to a meander shape of the connection element 304. However, not limit to this, in the present invention, the radiating-condition generating element can be any kinds of shapes or be composed of multiple branches depending on the system requirements. For example, please refer to FIG. 5A, which is a schematic diagram of an antenna 50 according to an embodiment of the present invention. Structures of the antenna 50 and the antenna 40 shown in FIG. 4 are similar, and thus same elements are denoted by the same symbols. Difference between the antenna 50 and the antenna 40 is that a radiating-condition generating element 408 of the antenna 50 is not only connected between the grounding element 300 and the radiating element 302, but also composed of two branches 5080 and 5082, which belongs to the double grounding structure of the present invention, and thus effects of multiple radiating conditions or broadband can be achieved as well.

Figure 5B:
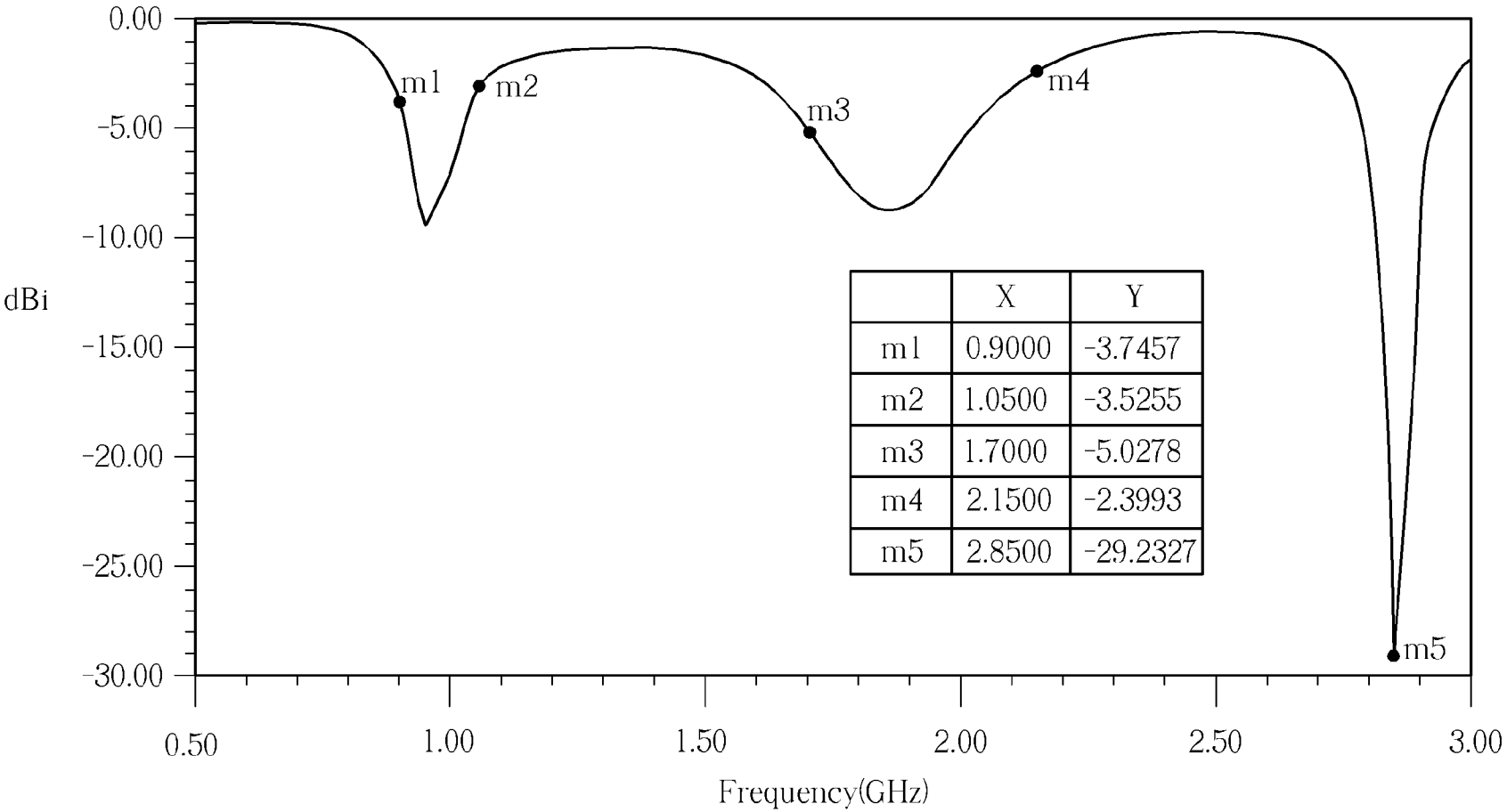
FIG. 5B is a schematic diagram of VSWR of the antenna shown in FIG. 5A.

Please continue to refer to FIG. 5B, which is a schematic diagram of VSWR of the antenna 50. As can be seen from FIG. 5, the antenna 50 can further generate a resonating radiating condition in high frequency band, and thus achieve multiple radiating conditions.

According to the above embodiments, the present invention resonates extra radiating conditions mainly through the radiating-condition generating element connected to the ground to achieve multiple radiating conditions or broadband operations. However, noticeably, as shown in FIG. 3 to FIG. 5, shape, position of the radiating-condition generating element, number of branches possessed by the radiating-condition generating element or whether the radiating-condition generating element is connected to the radiating element are not limited, those skilled in this art should make modifications accordingly, such that the resonating conditions generated by the radiating-condition generating element meet the system requirements, so as to achieve effects of multiple radiating condition or broadband operations. In addition, number of the radiating-condition generating element is not limited either, e.g. the present invention can further install multiple radiating-condition generating elements 308 in the antenna 30, install multiple radiating-condition generating elements 408 in the antenna 40, or share the radiating-condition generating element 308 and the radiating-condition generating element 408.

Figure 6A:
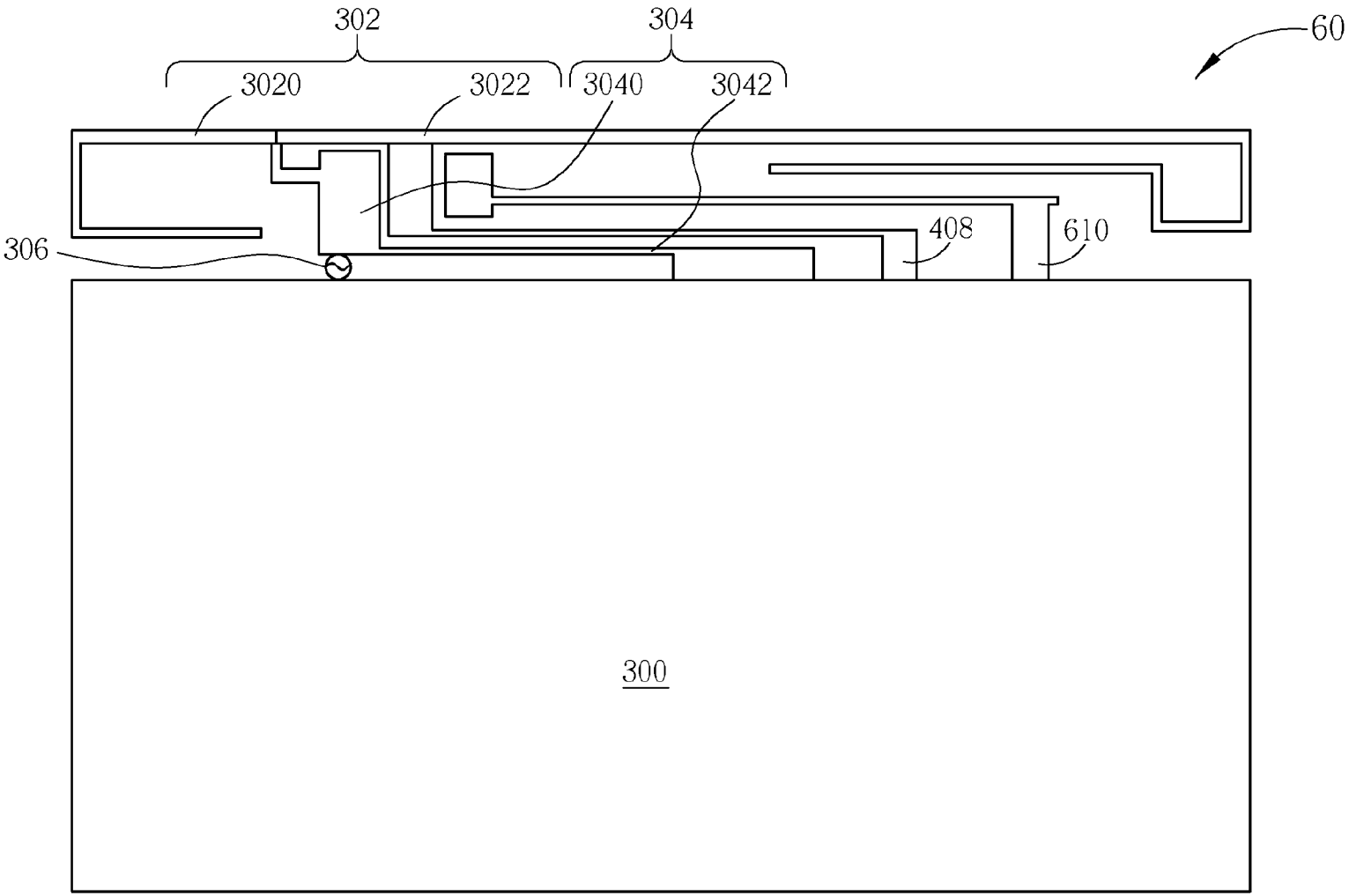
FIG. 6A is a schematic diagram of an antenna according to an embodiment of the present invention.
Figure 6B:
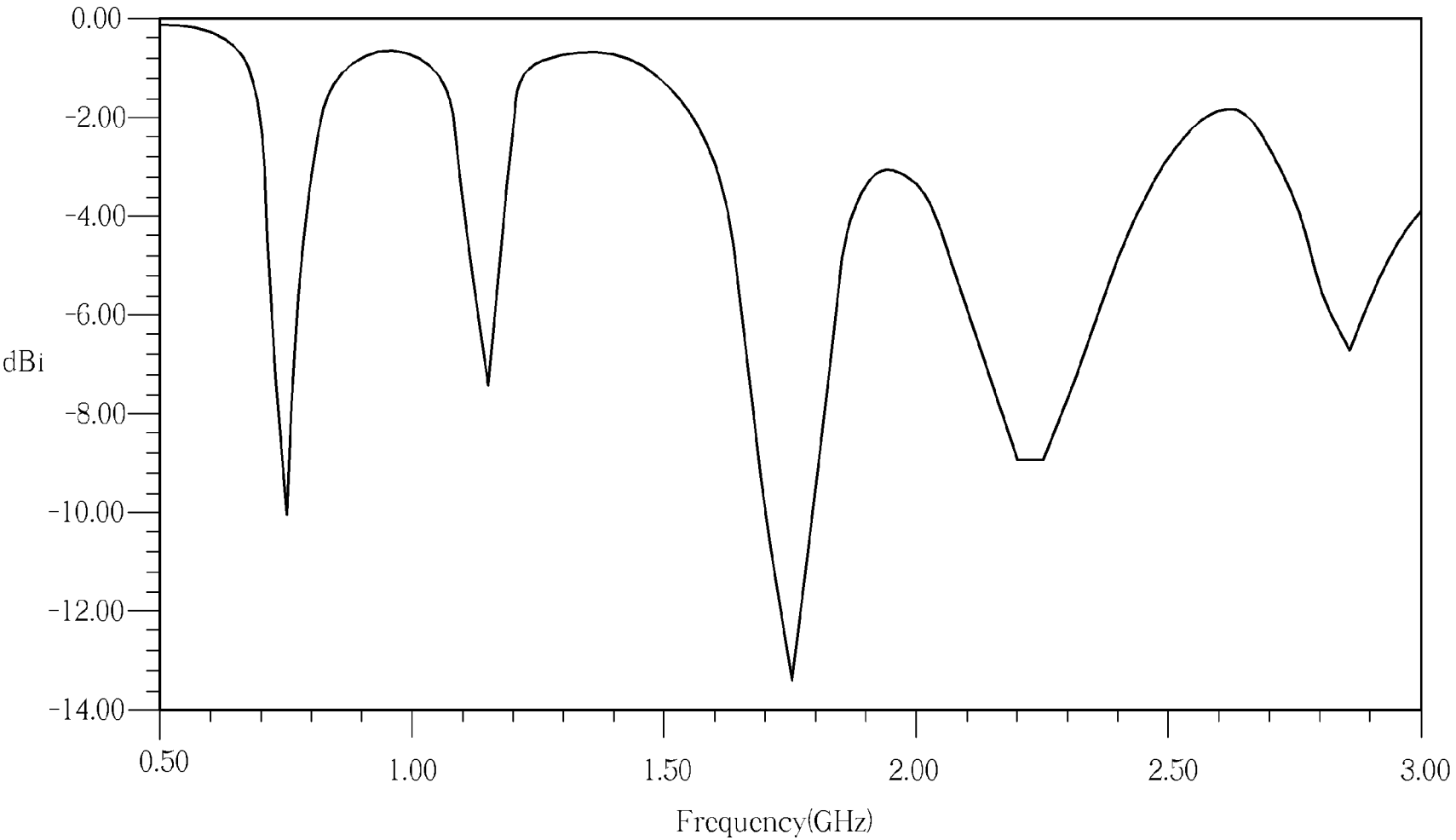
FIG. 6B is a schematic diagram of VSWR of the antenna shown in FIG. 6A.

For example, please refer to FIG. 6A, which is a schematic diagram of an antenna 60 according to an embodiment of the present invention. Structures of the antenna 60 and the antenna 40 shown in FIG. 4 are similar, and thus same elements are denoted by the same symbols. Difference between the antenna 60 and the antenna 40 is that the antenna 60 further adds a radiating-condition generating element 610 in addition to the radiating-condition generating element 408, and the radiating-condition generating element 610 is connected to the grounding element 300 but not connected to the radiating element 302, which is similar to the radiating-condition generating element 308. In such a situation, please continue to refer to FIG. 6B, which is a schematic diagram of VSWR of the antenna 60. As can be seen from FIG. 6B, the antenna 60 can generate 5 radiating conditions, and thus increase numbers of radiating conditions effectively.

It is known from above illustration, through increasing radiating-condition generating elements, the present invention can increase resonating conditions effectively, so as to improve antenna bandwidth. More important, as shown in FIG. 3, 4, 5A and 6A, the radiating-condition generating elements 308, 408, 508,608 and 610 all extend from the grounding element 300 to the radiating element 302. In other words, the present invention does not change appearance of the antenna, but lower the height of the antenna and reduce the antenna size effectively.

Noticeably, the abovementioned embodiments are used for illustrating concept of the present invention, those skilled in the art should make modifications accordingly, but not limit to this. For example, materials of the antennas 30, 40, 50, 60 can be metal materials, such as iron and copper, and the antennas 30, 40, 50, 60 can be disposed on another substrate, e.g. a printed circuit board (PCB). Furthermore, in FIG. 3, 4, 5A, 6A, each element is combined through direct connection, but not limit to this; for example, the grounding element 300 can be disposed on a substrate, while other elements can be disposed on another substrate, and both are connected by a flexible interface, and such operation is also one of alterations of the present invention. Besides, since antenna theory is well known by those skilled in the art, principles of antenna radiation are omitted for simplicity. In practice, when those skilled in the art design an antenna with multiple resonating conditions according to the present invention, characters such as sizes, materials and positions of elements should be adjusted according to the system requirement.

To sum up, the present invention adds one or multiple radiating-condition generating elements connected to the ground, such that the antennas resonates multiple radiating conditions to achieve broadband operations.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna with multiple resonating conditions, comprising:

a grounding element, electrically connected to a ground;

a radiating element;

a connection element, electrically connected between the grounding element and the radiating element;

a feed-in element, electrically connected between the connection element and the grounding element, for receiving feed-in signals; and a radiating-condition generating element, electrically connected to the grounding element, and extending from the grounding element to the radiating element;

wherein the radiating-condition generating element comprises a plurality of branches extending from the grounding element to the radiating element.

2. The antenna of claim 1, wherein the radiating element comprises:

a first radiator, extending along a first direction; and a second radiator, electrically connected to the first radiator, and extending along an opposite direction of the first direction;

wherein the connection element is electrically connected between the first radiator and the second radiator.

3. The antenna of claim 1, wherein the connection element comprises:

a first branch, electrically connected between the radiating element and the feed-in element; and a second branch, having a terminal electrically connected between the first branch and the feed-in element, and another terminal electrically connected to the grounding element.

4. The antenna of claim 1, wherein a shape of the radiating-condition generating element corresponds to a shape of the connection element.

5. The antenna of claim 1, wherein the radiating-condition generating element is close to the connection element, and extends from the grounding element to the radiating element.

6. The antenna of claim 1, wherein the radiating-condition generating element is further electrically connected to the radiating element.

7. An antenna with multiple resonating conditions, comprising:

a grounding element, electrically connected a ground;

a radiating element;

a connection element, electrically connected between the grounding element and the radiating element;

a feed-in element, electrically connected between the connection element and the grounding element, for receiving feed-in signals; and a plurality of radiating-condition generating elements, electrically connected to the grounding element, respectively, and extending from the grounding element to the radiating element;

wherein one of the plurality of radiating-conditions generating elements comprises a plurality of branches extending from the grounding element to the radiating element.

8. The antenna of claim 7, wherein the radiating element comprises:

a first radiator, extending along a first direction; and a second radiator, electrically connected to the first radiator, and extending along an opposite direction of the first direction;

wherein the connection element is electrically connected between the first radiator and the second radiator.

9. The antenna of claim 7, wherein the connection element comprises:

a first branch, electrically connected between the radiating element and the feed-in element; and a second branch, having a terminal electrically connected between the first branch and the feed-in element, and another terminal electrically connected to the grounding element.

10. The antenna of claim 7, wherein a shape of one of the plurality of radiating-condition generating elements corresponds to a shape of the connection element.

11. The antenna of claim 7, wherein one of the plurality of radiating-condition generating elements is close to the connection element, and extends from the grounding element to the radiating element.

12. The antenna of claim 7, wherein one of the plurality of radiating-conditions generating elements is further electrically connected to the radiating element.

* * * * *